US005884382A

United States Patent [19]

Hansen

[11] Patent Number: 5,884,382

[45] Date of Patent: Mar. 23, 1999

[54] BELT BUCKLE COVER APPARATUS AND SCRATCH PREVENTION METHOD

[76] Inventor: Jimmy J. Hansen, 10646 173rd Ave., Becker, Minn. 55308

[21] Appl. No.: 841,243

[22] Filed: Apr. 29, 1997

[51] Int. Cl.[6] ..... A44B 11/00

[52] U.S. Cl. ..... 24/442; 24/573.1; 24/633

[58] Field of Search ..... 24/442, 633, 634, 24/573.1, 163 K

[56] References Cited

U.S. PATENT DOCUMENTS

| | | | |
|---|---|---|---|
| 1,638,073 | 8/1927 | Van Heusen | 24/442 |
| 3,370,818 | 2/1968 | Perr | 24/442 |
| 3,817,245 | 6/1974 | Kroeger | 128/134 |
| 3,891,274 | 6/1975 | Cook et al. | 297/389 |
| 3,936,075 | 2/1976 | Jeliffe | 280/150 B |
| 3,940,873 | 3/1976 | Lawless | 24/442 |
| 4,502,194 | 3/1985 | Morris et al. | 24/633 |
| 4,675,954 | 6/1987 | Gullickson | 24/573.1 |
| 4,699,401 | 10/1987 | Saenz | 280/808 |
| 4,878,277 | 11/1989 | Portuese | 24/573.1 |
| 4,939,824 | 7/1990 | Reed | 24/573.1 |
| 4,961,251 | 10/1990 | Smith | 24/633 |
| 5,295,267 | 3/1994 | Galindo | 2/2 |
| 5,370,622 | 12/1994 | Livingston et al. | 604/151 |
| 5,375,262 | 12/1994 | Carter | 2/23 |
| 5,471,680 | 12/1995 | Vesterinen | 2/44 |
| 5,598,583 | 2/1997 | Victor et al. | 2/46 |

*Primary Examiner*—Victor N. Sakran
*Attorney, Agent, or Firm*—Schwegman, Lundberg, Woessner & Kluth, P.A.

[57] ABSTRACT

A belt buckle cover includes a first connector portion, a second connector portion, and a third conformable portion located between said first connector portion and second connector portion. The first connector portion, the second connector portion and the third conformable portion are made of a scratch resistant material or fabric. Typically, one or two properly dimensioned pieces of scratch resistant fabric are used. One half of a two part fastener is attached to the first connector portion and the other half of a two part fastener is attached to the second connector portion. One half of a two part fastener is attached to one side of the scratch resistant fabric and the other half of a two part fastener is attached to the other side of the scratch resistant fabric. The conformable portion of the belt cover does not have any edges outside the out periphery of the belt buckle which may dig into the user to cause discomfort. This assures that the user will not find that the belt cover is uncomfortable and remove the belt cover for that reason.

In operation, the cover is quickly and easily placed over a belt buckle. The cover is initially placed behind the belt buckle so that the conformable portion is behind the belt buckle and the first connection portion and the second connection portion extend above and below the belt. The first portion is then folded over the front of the belt buckle to position one portion of the hook and loop fastener in an attachable position. The second portion of the cover is then folded over the front of the belt buckle to attach the second portion of the hook and loop fastener to the first portion of the hook and loop fastener. The cover may then be moved along the length of the belt to reposition the cover to a position where the belt buckle is in the middle of the cover.

12 Claims, 3 Drawing Sheets

BELT BUCKLE COVER APPARATUS AND SCRATCH PREVENTION METHOD

FIELD OF THE INVENTION

The present invention relates generally to a method and apparatus for covering a belt buckle. More particularly, the present invention relates to methods and apparatus used for covering a belt buckle to prevent the belt buckle from scratching other surfaces.

BACKGROUND OF THE INVENTION

A scratch in a car or truck fender is expensive to fix even for an auto dealer of truck dealer with their own body shop. Body shops typically charge in excess of $100 to fix a deep scratch which can not be merely buffed out. When such a scratch occurs, the dealer or mechanic is essentially out the cost for the repairing the scratch. In addition, the customer is typically very unhappy as the scratch repair adds time to the total repair and may damage the reputation of the dealership. Customers may think that if the mechanic is not careful with the fender, that he or she also did not care about the quality of the mechanical repair. In order to keep their customers happy and to prevent the additional expense associated with fixing a scratch, repair facilities typically drape a padded protector over a car fender before working on the engine of an automobile or truck. This allows a mechanic to access the engine from above by leaning on the car or truck fender without the fear of scratching the surface of the fender with his or her belt buckle.

Even with padded fender protectors scratches in car fenders do occur from time to time. As a matter of fact, its a constant problem in repair shops of all kinds. Mechanics sometimes forget or simply do not want to spend the time moving the padded protector from one fender on the car or truck to the other, especially when the mechanic only needs access the other side of the engine for a short time or for a small task. Other personnel, such as those that do relatively unskilled tasks such as changing windshield wipers, may perform this task on the car lot. Sometimes they lean on the fenders, especially when changing the windshield wipers on a larger car, van or truck. The end result may be an accidental scratch on the fender which must be repaired. Service stations that offer full service have also had this problem. The attendant may inadvertently scratch the fender when washing the windshield for the customer.

There are other industries where this problem exists. For example, movers of furniture may scratch a table, book shelf, desk, or chair. Warehouseman have been known to scratch items stored in the warehouse. In essence, in any industry concerned with delivering a product with a fine finish there is a problem with scratches from belt buckles of the personnel working in that industry.

Some belt buckle covers exist, but they seem to exist to prevent scratches in the belt buckle rather than the other way around. For example, in country western clothing stores, leather belt buckle covers that strap over large, ornate belt buckles prevent scratches in the belt buckle. The leather unit is typically attached to the belt buckle with several straps of elastic. Over time, the elastic gives which exposes other surfaces to scratches by the belt buckle.

As a result, there is a widespread need for a belt cover that is comfortable to wear so that the user essentially forgets about the device. Comfort is key as the user should not remove the belt cover due to discomfort. There is also a need for a belt cover that stays in place once attached, and yet can be easily placed over the belt buckle and easily removed from the belt buckle. The user should also be able to put the belt cover in place quickly and with little skill.

SUMMARY OF THE INVENTION

A belt buckle cover includes a first connector portion, a second connector portion, and a third conformable portion located between said first connector portion and second connector portion. The first connector portion, the second connector portion and the third conformable portion are made of a scratch resistant material or fabric. Typically, one or two properly dimensioned pieces of scratch resistant fabric are used. One half of a two part fastener is attached to the first connector portion and the other half of a two part fastener is attached to the second connector portion. One half of a two part fastener is attached to one side of the scratch resistant fabric and the other half of a two part fastener is attached to the other side of the scratch resistant fabric. The two part fastener is a Velcro type fastener in which one half of the fastener features a plurality of loops and the other half of the fastener features a plurality of hooks. The conformable portion of the belt cover does not have any edges outside the out periphery of the belt buckle which may dig into the user to cause discomfort. This assures that the user will not find that the belt cover is uncomfortable and remove the belt cover for that reason.

In operation, the cover is quickly and easily placed over a belt buckle. The cover is initially placed behind the belt buckle so that the conformable portion is behind the belt buckle and the first connection portion and the second connection portion extend above and below the belt. The first portion is then folded over the front of the belt buckle to position one portion of the hook and loop fastener in an attachable position. The second portion of the cover is then folded over the front of the belt buckle to attach the second portion of the hook and loop fastener to the first portion of the hook and loop fastener. The cover may then be moved along the length of the belt to reposition the cover to a position where the belt buckle is in the middle of the cover. This covers the belt buckle to minimize the potential for inadvertent scratches caused by the belt cover.

Advantageously, the belt cover is very comfortable to wear. The user essentially forgets about the belt cover while it is in use. In addition, the belt cover stays in place once attached but is easily placed over the belt buckle and quickly attached to it. In addition, the belt cover can be easily removed from the belt buckle. Little skill is needed by the user to quickly place the belt cover over his or her belt buckle. In addition, the belt cover is small enough to fit in a pocket or in a top tray of a tool chest. The belt cover is also much less costly than the scratches they prevent.

BRIEF DESCRIPTION OF THE DRAWINGS

For a better understanding of the present invention, reference may be made to the accompanying drawings in which.

DESCRIPTION OF THE EMBODIMENT

In the following detailed description of the embodiment, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present inventions. The following detailed description is, therefore, not to be taken in a limiting sense, and the scope of the present inventions is defined only by the appended claims.

Figure 1:
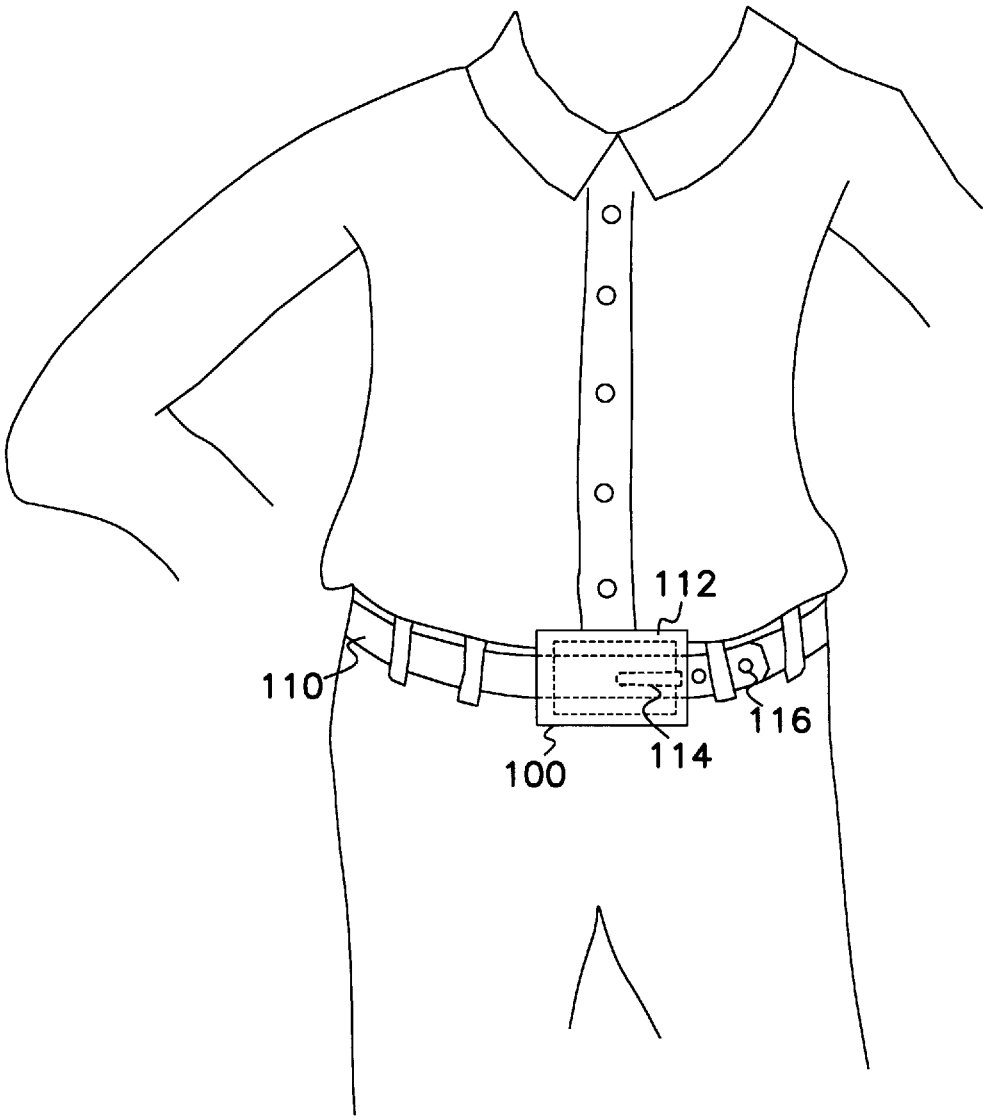
FIG. 1 is a view of the belt buckle cover covering a belt buckle.

FIG. 1 is a view of a belt buckle cover 100 being used on a belt 110 of a user. The belt 110 includes a belt buckle 112 which also includes a prong 114 for locking the belt into one of several positions. The prong 114 engages one of several openings, such as 116, in the belt 110. The belt buckle cover 100 covers the belt buckle 112 and the prong 114 as well as a portion of the belt 110. The belt buckle 112 and the prong 114, if left uncovered, may scratch a surface. When the belt buckle cover 100 is in place, the belt buckle and the prong 114 are covered with a scratch-resistant material to reduce or totally eliminate the possiblity of scratches.

Figure 2:
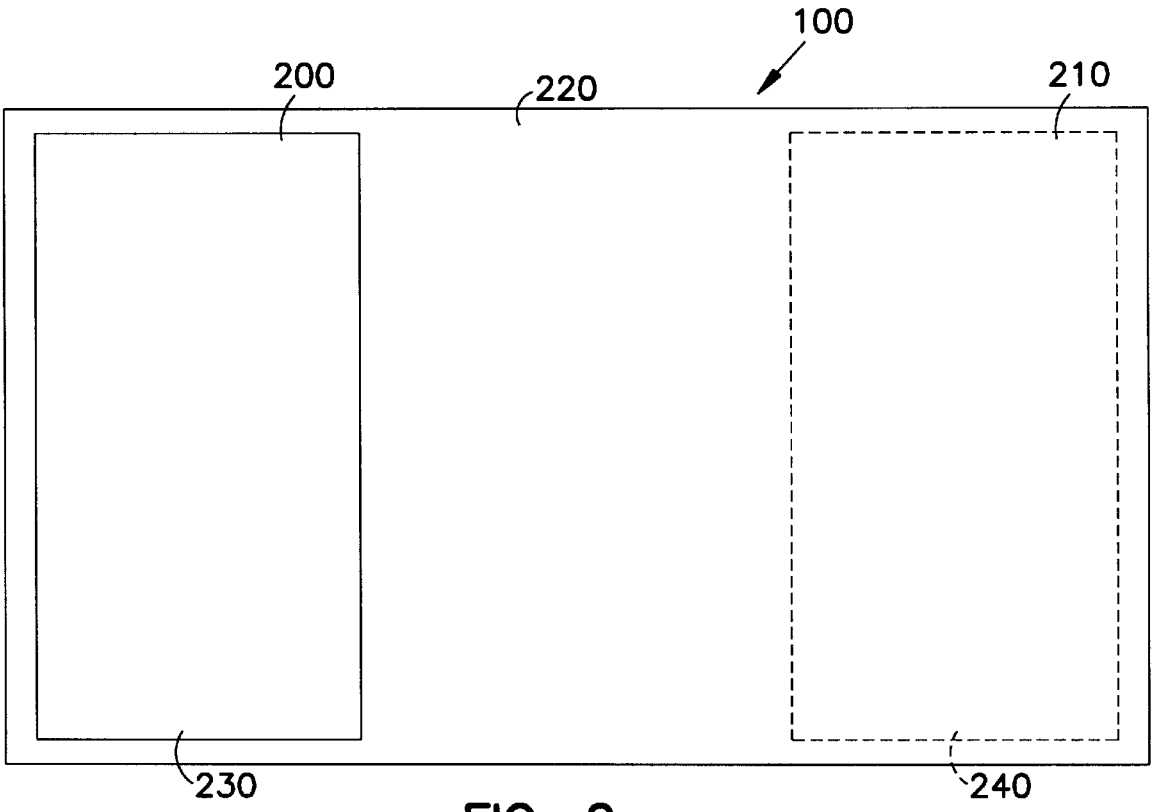
FIG. 2 is a plan view of the belt buckle cover.

Now turning to FIG. 2, the belt buckle cover 100 is a sheet or length of scratch-resistant material that can be thought of as being divided into three different portions. The three portions are a first connector portion 200, a second connector portion 210, and a third conformable portion 220. First connector portion 200 and the second connector portion 210 each include one half of a hook-and-loop fastener, such as those sold under the trade name Velcro. The first connector portion carries one-half of a hook and loop fastener 230, and the second connector portion 210 carries the other half of a hook and loop fastener 240. For example, the first connector portion 200 may carry the hook-type fabric and the second connector portion 210 may carry the loop portion of the connector. The fastening material can be attached to the scratch resistant fabric by any of a number of ways. For example, one-half of the hook-and-loop fastener 230 can be attached to the first connector portion 200 using an adhesive, a bonding agent, or by sewing. Similarly, the other half of the hook-and-loop fastener can be attached to the second connector portion 210 by use of an adhesive, by bonding or by sewing.

Figure 3:
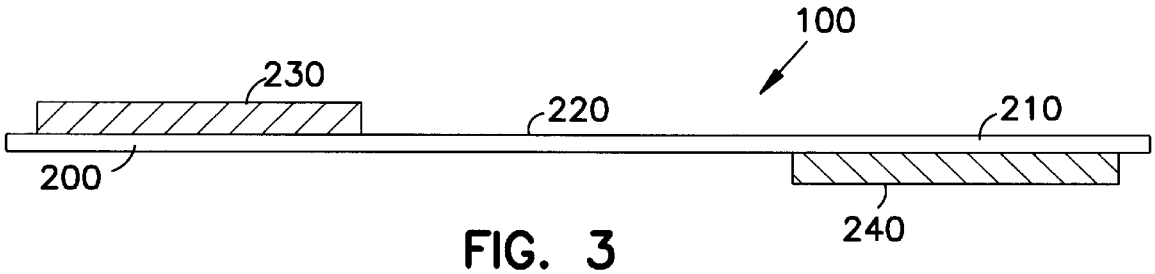
FIG. 3 is a side view of the belt buckle cover shown in FIG. 2.

As shown in FIG. 2, one-half of the hook-and-loop fastener 230 is attached to the first connection portion 200 on one side of the scratch-resistant material and the other half of the hook-and-loop fastener 240 is attached on the other side of the scratch-resistant material. This is also clearly shown in FIG. 3. The third conformable portion 220 is positioned between the first connector portion 200 and the second connector portion 210. The conformable portion does not contain a rigid member which extends beyond the periphery of the belt buckle 112. Since the conformable portion 220 of the belt buckle cover 100 is flexible and conformable, it is very comfortable for a user to wear If a rigid or hard member is included in the conformable region 220, there is a possibility that an edge of the rigid or hard may be presented to the user's abdomen. The edge of such a rigid or hard piece may dig into the user's abdomen and cause discomfort. As a result of such discomfort, a user may decide to remove the belt buckle cover. Rather than risk a user not wearing the belt buckle cover 100, there is no rigid member or at least there is no rigid member extending beyond the periphery of the belt buckle 112. This assures that the user will continue to wear the belt buckle cover 100 since it is comfortable.

Figure 4:
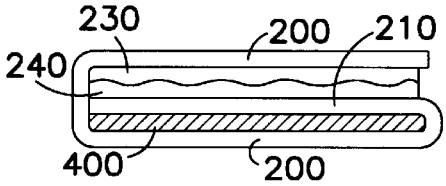
FIG. 4 is a cutaway side view of the belt buckle cover applied to a belt buckle.

Now turning to FIG. 4, a cutaway side view of buckle cover 100 applied to another type of belt buckle 400 is shown. The belt buckle 400 is a solid belt buckle. As can be shown, the conformable portion 200 is adjacent or closest to the user. The conformable portion is also between the belt buckle 400 and the user. On the other side of the belt buckle, more distant from the user, are several layers including the first connecting portion 200, the second connecting portion 210 and the first half of the hook-and-loop fastener 230 and the second half of the hook-and-loop fastener 240. As a result, four layers of fabric cover the buckle 400 and the prong used to lock the belt in place (shown in FIG. 1). The four layers prevent scratching by the buckle 400. The conformable portion 200 is conformable or flexible so that wearing the belt buckle cover 100 is comfortable for the user. The surface most distant from the user associated with the first connecting portion 200 can be adorned with a logo or other advertisement or saying. In this way the belt buckle cover can be sold to advertisers to advertise tools or other products that they would like to market.

Figure 5:
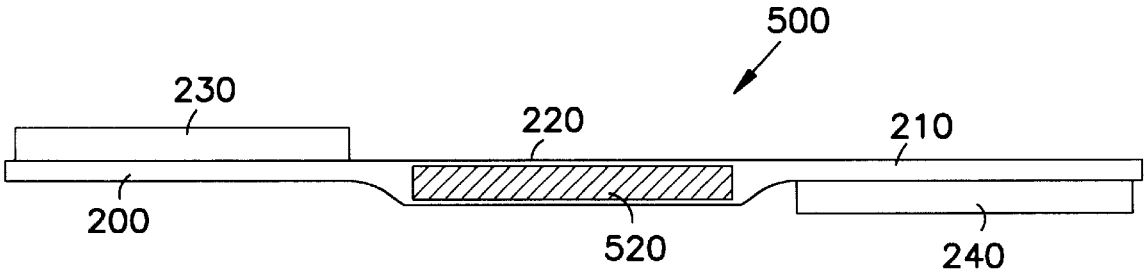
FIG. 5 is a side view of another embodiment of the belt buckle cover.

FIG. 5 is a side view of another embodiment of a belt buckle cover 500. Belt buckle cover 500 includes a first connecting portion 200, a second connecting portion 210 and a conformable portion 220. The first connector portion 200 carries one-half of a hook-and-loop fastener 230. The second connector portion 210 carries the other half of a hook-and-loop fastener 240. The intermediate portion carries an extra pad which can be attached to the exterior of the belt buckle cover 500 or sewn into or adhered to an interior portion of the belt buckle cover 500. This pad 520 merely adds to the comfort the user experiences while wearing the belt buckle cover 500. In addition, the pad 520 may prevent scratching of exterior surfaces by the belt buckle 112 and the prong 114 if the user should wear the belt buckle cover 500 in a backwards fashion. If worn in a backwards fashion, the soft conformable portion 220 would be most distant from the user. The padding 520 would prevent scratches in fine surfaces that the user might otherwise make without the belt buckle cover 500.

Figure 6:
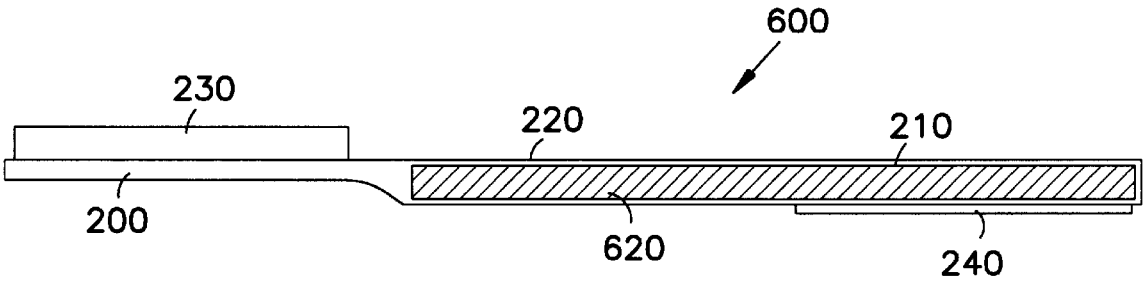
FIG. 6 is a side view of still another embodiment of the belt buckle cover.

FIG. 6 shows yet another embodiment of a belt buckle cover 600. Many of the parts of the belt buckle cover 600 are in common with the belt buckle cover 500 and the belt buckle cover 100. A descripton of these will not be repeated here. Belt buckle cover 600 differs from belt buckle cover 500 in that belt buckle cover 600 has a pad 620 which extends from the conformable portion 220 and into one of the connector portions 210 or 200. In this particular embodiment, the pad 620 extends into the second connector portion 210. The pad 620 serves to add to the comfort for the user and also serves to prevent damage to exterior surfaces through scratching should the user wear the belt buckle cover 600 in an unintended orientation. In addition, the extension into one of the connecting portions 210, 200, adds additional layers between the belt buckle 112 and the prong 114 when the belt buckle cover 600 is worn in its normal orientation. It should be noted that the pad 520 or 620 must be made of a conformable material such as foam rubber or felt.

Figure 7:
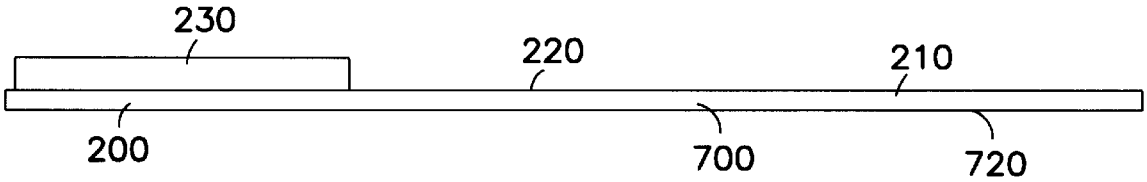
FIG. 7 is a side view of yet another embodiment of the belt buckle cover.

FIG. 7 shows another embodiment of a belt buckle cover 700. Many of the parts of the belt buckle cover 700 are in common with the belt buckle cover 500, the belt buckle cover 600, and the belt buckle cover 100. A descripton of these common elements or parts will not be repeated here. Belt buckle cover 700 differs from belt buckle covers 100, 500 and 600 in that belt buckle cover 700 is made of a material that serves as one half of a hook and loop fastner. In other words, the surface 710 of the belt cover 700 serves as one half of the fastner. The surface 720 of the second connection portion 210 is formed of the material which includes loops to which a fastner 230 having hooks directly attaches.

In operation the belt buckle cover 100, 500, 600 or 700 is very easy to place onto the belt. The belt buckle cover 100, 500, 600 or 700 is tucked behind the buckle 112 and positioned so that the conformable portion 220 is between the belt buckle 112 and the user. The lower portion or the second connector portion 210 is then folded up to cover the front of the belt buckle 112. The upper portion or first connector portion 200 is then folded downwardly to cover the second connector portion 210. The first connector portion 200 is pressed into the second connector portion 210 so that the two halves of the hook-and-loop fastener 230, 240 engage one another. The hook-and-loop fastener stays attached while the user carries on his normal tasks, yet advantageously, the belt buckle cover is easily removed by grabbing the first connector portion 200 and applying a force to disengage it from the second connector portion 210. This allows a user to gain easy access to the belt buckle 112 and the belt 110 in the event that he or she needs to release the belt during the day or in the event that the belt must be loosened or tightened as need be. The belt buckle cover 100, 500, 600 or 700 can be easily used by persons of all ages. Even children of a very young age could be provided with a belt buckle cover and could use it with ease.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An apparatus for covering a belt buckle comprising:

a first connector portion of a plurality of hook fasteners for covering a portion of the front face of the belt buckle;

a second connector portion of a plurality of loop fasteners for covering the rear face of the belt buckle, said second connector portion overlapping the first connector portion; and a third conformable portion located on the rear face of the belt buckle between said first connector portion and second connector portion of the apparatus, said third portion positioned between said connectors, the belt buckle and the wearer.

2. The apparatus of claim 1, wherein one of said first connector portion or said second connector portion includes a plurality of hook fasteners and the other of said first connector portion or said second connector portion includes a plurality of loop fasteners which mate with the plurality of hook fasteners to attach the first portion to the second portion.

3. The apparatus of claim 1 wherein said first connector portion, said second connector portion, and said third conformable portion are made of a scratch resistant material.

4. The apparatus of claim 3 wherein the third conformable portion further comprises a padding material.

5. The apparatus of claim 4 wherein one of the first connector portion or said second connector portion further comprises a padding material.

6. The apparatus of claim 3 wherein said first connector portion, said second connector portion, and said third conformable portion further comprise a padding material.

7. The apparatus of claim 3 wherein said plurality of hook fasteners are attached to one side of the scratch resistant material and said plurality of loop fasteners are attached to the other side of the scratch resistant material.

8. The apparatus of claim 1 wherein said first connector portion, said second connector portion, and said third conformable portion are made of fabric.

9. A method for covering a belt buckle with a cover made of a scratch resistant material having one portion of a hook and loop fastener attached to a first portion of the cover and having the other portion of a hook and loop fastener attached to a second portion of the cover, said method comprising the steps of:

placing the cover behind a belt buckle;

folding a first portion of the cover over the front of the belt buckle and to position one portion of the hook and loop fastener in an attachable position; and folding a second portion of the cover over the front of the belt buckle and over the first portion of the cover to attach the second portion of the hook and loop fastener to the first portion of the hook and loop fastener, said first and second portions covering the front of the belt buckle.

10. The method of claim 9 further comprising the step of moving the cover along the length of the belt.

11. The method of claim 9 further comprising the step of moving the cover along the length of the belt to reposition the cover to a position where the belt buckle is in the middle of the cover.

12. The method of claim 9 further comprising the step of positioning the hook and loop fastener behind the belt buckle.

* * * * *

UNITED STATES PATENT AND TRADEMARK OFFICE

CERTIFICATE OF CORRECTION

PATENT NO. : 5,884,382
DATED : March 23,1999
INVENTOR(S) : Hansen

It is certified that error appears in the above-identified patent and that said Letters Patent is hereby corrected as shown below:

In column 5, line 47, after "covering", insert--a portion of--,therefore.

Signed and Sealed this

Sixteenth Day of May, 2000

*Attest:*

Q. TODD DICKINSON

*Attesting Officer*

*Director of Patents and Trademarks*